US007621771B2

(12) United States Patent
Petzl et al.

(10) Patent No.: US 7,621,771 B2
(45) Date of Patent: Nov. 24, 2009

(54) DEVICE FOR ELECTRIC CONNECTION BETWEEN A PORTABLE RECEIVER AND A POWER SOURCE

(75) Inventors: Paul Petzl, Barraux (FR); Philippe Berrel, La Chapelle du Bard (FR); Stephane Huguenin, Grenoble (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 12/230,671

(22) Filed: Sep. 3, 2008

(65) Prior Publication Data

US 2009/0093148 A1 Apr. 9, 2009

(30) Foreign Application Priority Data

Oct. 8, 2007 (FR) ..... 07 07054

(51) Int. Cl.
*H01R 13/62* (2006.01)

(52) U.S. Cl. ..... 439/358

(58) Field of Classification Search ..... 439/350–358, 439/606

See application file for complete search history.

(56) References Cited

U.S. PATENT DOCUMENTS

| | | | | |
|---|---|---|---|---|
| 4,420,216 | A | 12/1983 | Motoyama et al. | |
| 5,256,953 | A | 10/1993 | Cimbal et al. | |
| 5,530,334 | A | 6/1996 | Ramspeck et al. | |
| 5,647,751 | A * | 7/1997 | Shulman et al. | 439/106 |
| 6,132,234 | A | 10/2000 | Waidner et al. | |
| 7,121,899 | B2 | 10/2006 | Homann et al. | |
| 2002/0119693 | A1 * | 8/2002 | Chen | 439/358 |
| 2004/0166717 | A1 * | 8/2004 | Muro et al. | 439/358 |
| 2005/0130483 | A1 * | 6/2005 | Ishiyama | 439/358 |
| 2006/0166545 | A1 * | 7/2006 | Tanaka et al. | 439/358 |

FOREIGN PATENT DOCUMENTS

| | | | |
|---|---|---|---|
| DE | 43 09 034 | A1 | 9/1994 |
| DE | 203 09 812 | U1 | 1/2004 |
| DE | 203 18 583 | U1 | 3/2005 |
| EP | 0 154 412 | | 9/1985 |
| EP | 0 499 840 | A2 | 8/1992 |

* cited by examiner

*Primary Examiner*—Gary F. Paumen
(74) *Attorney, Agent, or Firm*—Oliff & Berridge, PLC

(57) ABSTRACT

A device for electric connection between a power supply connection of a portable receiver and a DC power source housed in an insulating case, comprising a first connector arranged at the end of the power supply connection and designed to be electrically connected to a second connector securedly attached to the case of the power source. The first connector comprises a pair of female contacts overmolded by an insulating enclosure bearing a securing element operating by clipping in conjunction with latching means associated with the second connector, which is provided with a pair of male contacts arranged in a housing of the case of the power source. The latching means of the second connector are fixed to the case above the housing.

4 Claims, 9 Drawing Sheets

DEVICE FOR ELECTRIC CONNECTION BETWEEN A PORTABLE RECEIVER AND A POWER SOURCE

BACKGROUND OF THE INVENTION

The invention relates to a device for electric connection between a power supply connection of a portable receiver and a DC power source, housed in an insulating case and comprising:

- a first connector arranged at the end of the power supply connection and designed to be electrically connected to a second connector securedly attached to the case of the power source,
- and means for guiding in translation for centring the connectors in the plug-in direction.

STATE OF THE ART

Front-mounted lighting lamps use a low-voltage power source housed in a case separate from the lamp and connected to the latter by two power supply wires connected to the positive and negative poles of the power source. The case of the power source is generally fixed at the back of the user's head, and is supported by a fixing with an elastic strap. Electric connection is performed by connectors located inside the case. The connection and disconnection operations do however remain complicated when the batteries have to be replaced, and require particular care when fitting the connectors.

The document U.S. Pat. No. 4,420,216 describes a coaxial connecting device to connect an external microphone to a recorder. A flexible blade keeps the connector plug in the plugged-in position. The document U.S. Pat. No. 6,132,234 refers to a coaxial connector having contact elements and locking fingers supported by the connector body.

OBJECT OF THE INVENTION

The object of the invention consists in providing a safe and reliable multiple connection device for a low-voltage portable receiver enabling the power source or a support plate to be connected and disconnected quickly.

The device according to the invention is characterized in that the first connector comprises a pair of female contacts overmolded by an insulating enclosure bearing a securing element operating by clipping in conjunction with a latching means associated with the second connector, which second connector is provided with a pair of male contacts arranged in a housing of the case of the power source, the latching means of the second connector being fixed onto the case above the housing.

The latching means can be formed by a pivoting lever biased by a spring to a latching position to latch the contacts in the plugged-in position.

The electric connection can be connected directly to the power source by inserting the first connector in the second connector with good guiding in translation during the plug-in travel. Mechanical latching of the connectors is performed at the end of plug-in travel, preventing any nuisance disconnection.

Another connection mode of the connectors can be performed on a support plate which comprises a fixing rail in the form of a dovetail profile, and a central opening of conjugate shape to that of the securing element. Guiding in translation is performed by a slide of the case of the power source sliding along the rail of the plate. This results in axial centring of the male contacts of the second connector on the female contacts of the first connector already fitted on the plate. Electric connection of the receiver is then performed, and mechanical fixing of the power source on the plate is performed at the same time.

BRIEF DESCRIPTION OF THE DRAWINGS

Other advantages and features will become more clearly apparent from the following description of an embodiment of the invention given for non-restrictive example purposes only and represented in the accompanying drawings, in which:

FIG. 4 is an exploded perspective view of the power source illustrated from the side opposite plug-in;

DETAILED DESCRIPTION OF THE INVENTION

Figure 1:
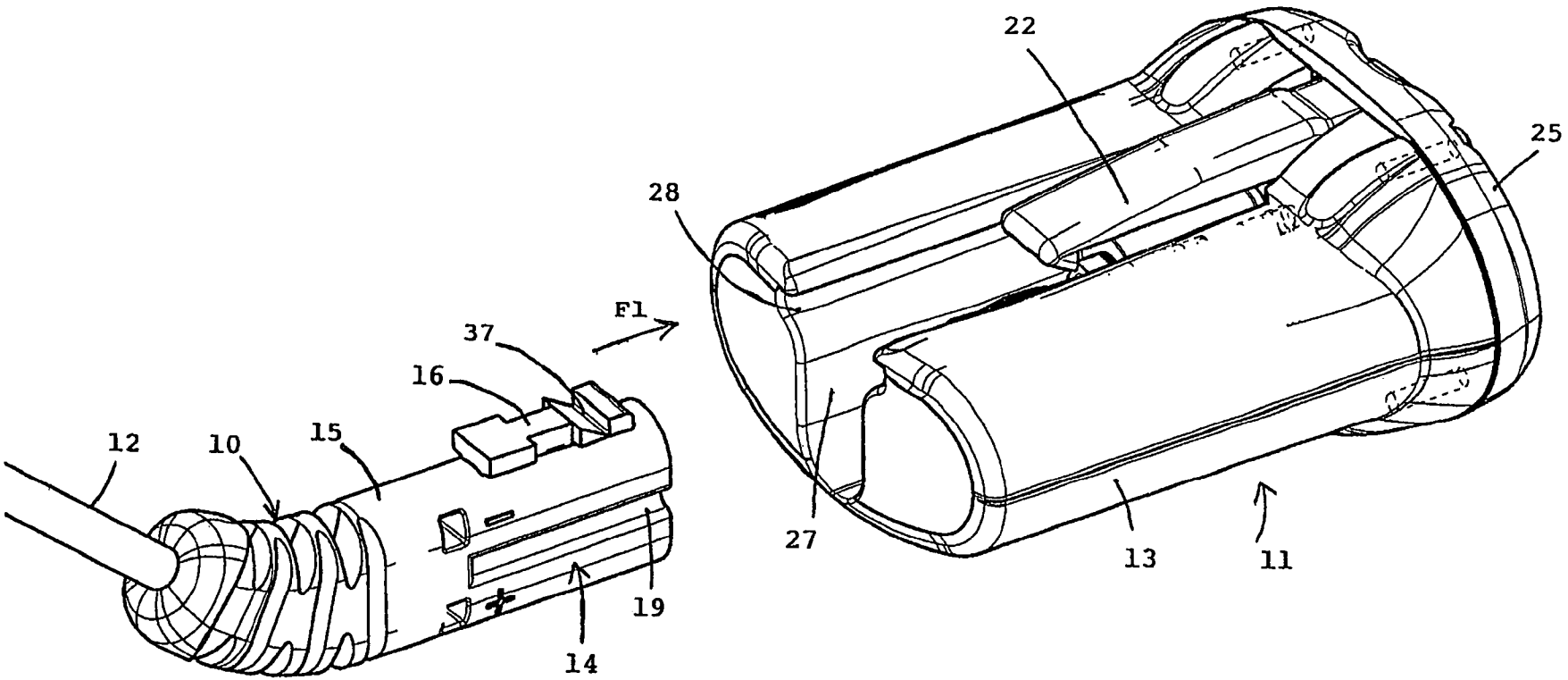
FIG. 1 shows an exploded perspective view of the connection device according to the invention, the first connector of the electric connection to the receiver being disconnected from the power source.
Figure 2:
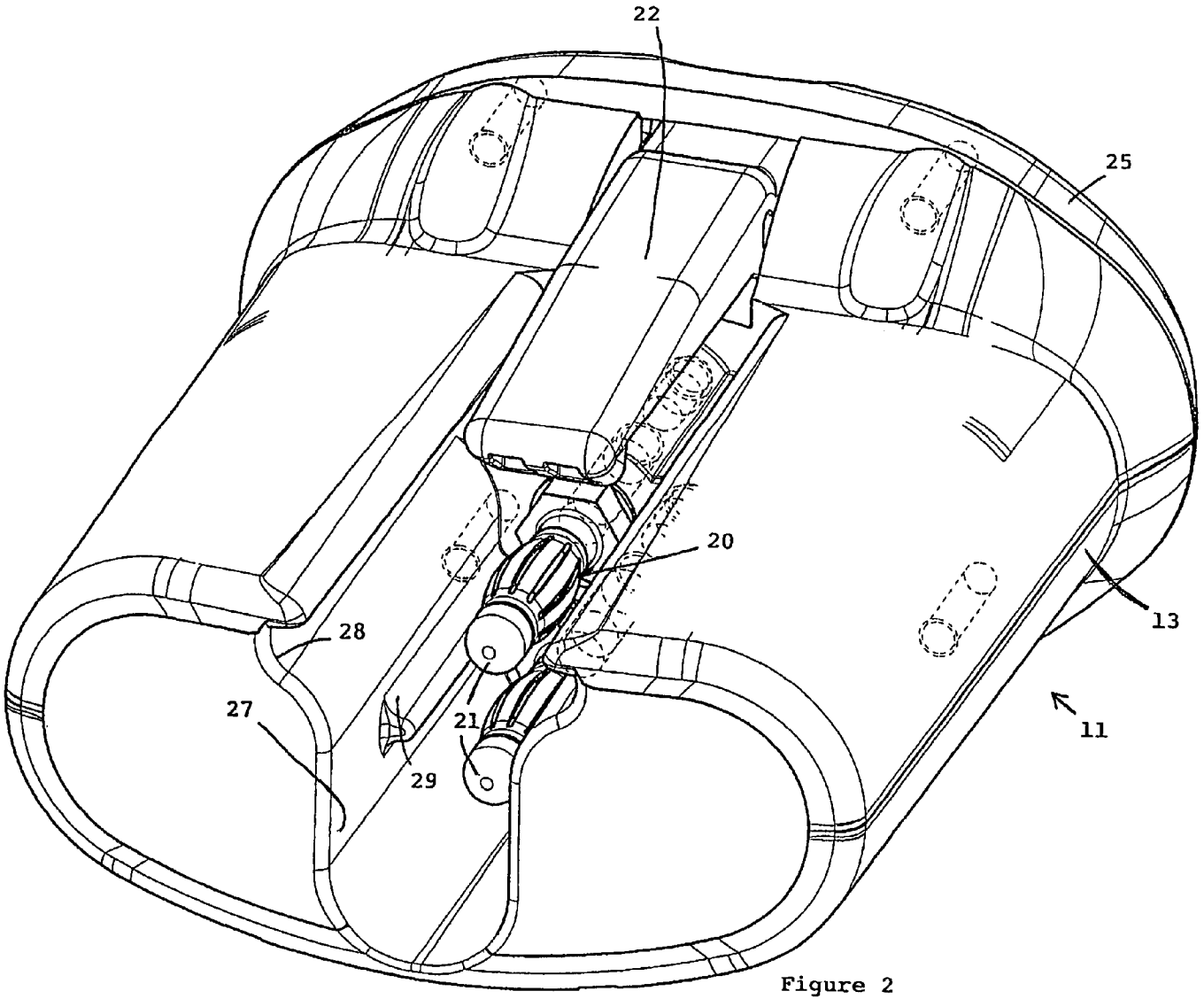
FIG. 2 represents a perspective view of the power source illustrating the arrangement of the second connector of the latching means in the housing with a slide of the case.
Figure 3:
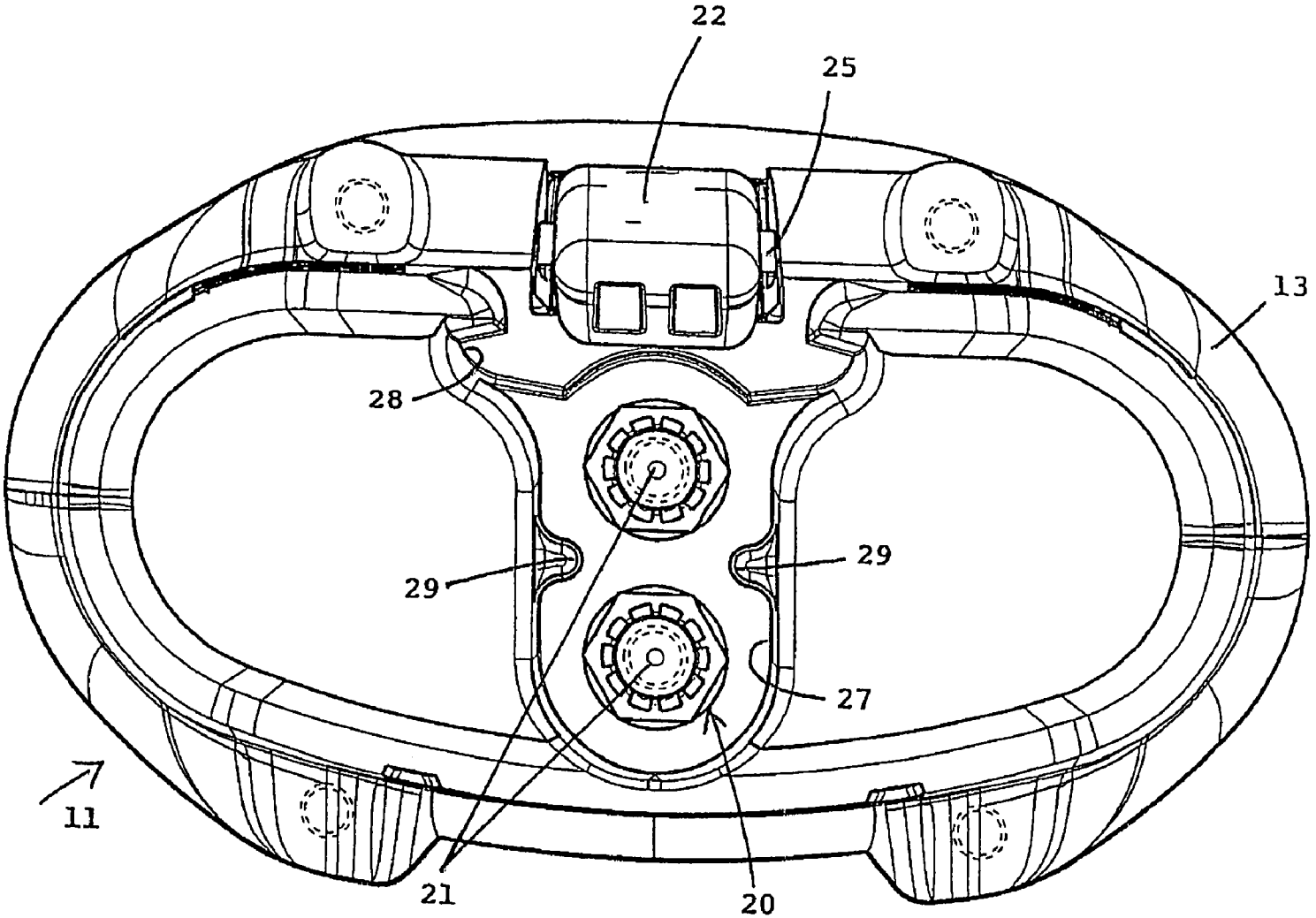
FIG. 3 is a side view of FIG. 1 showing the power source on the plug-in side.
Figure 4:
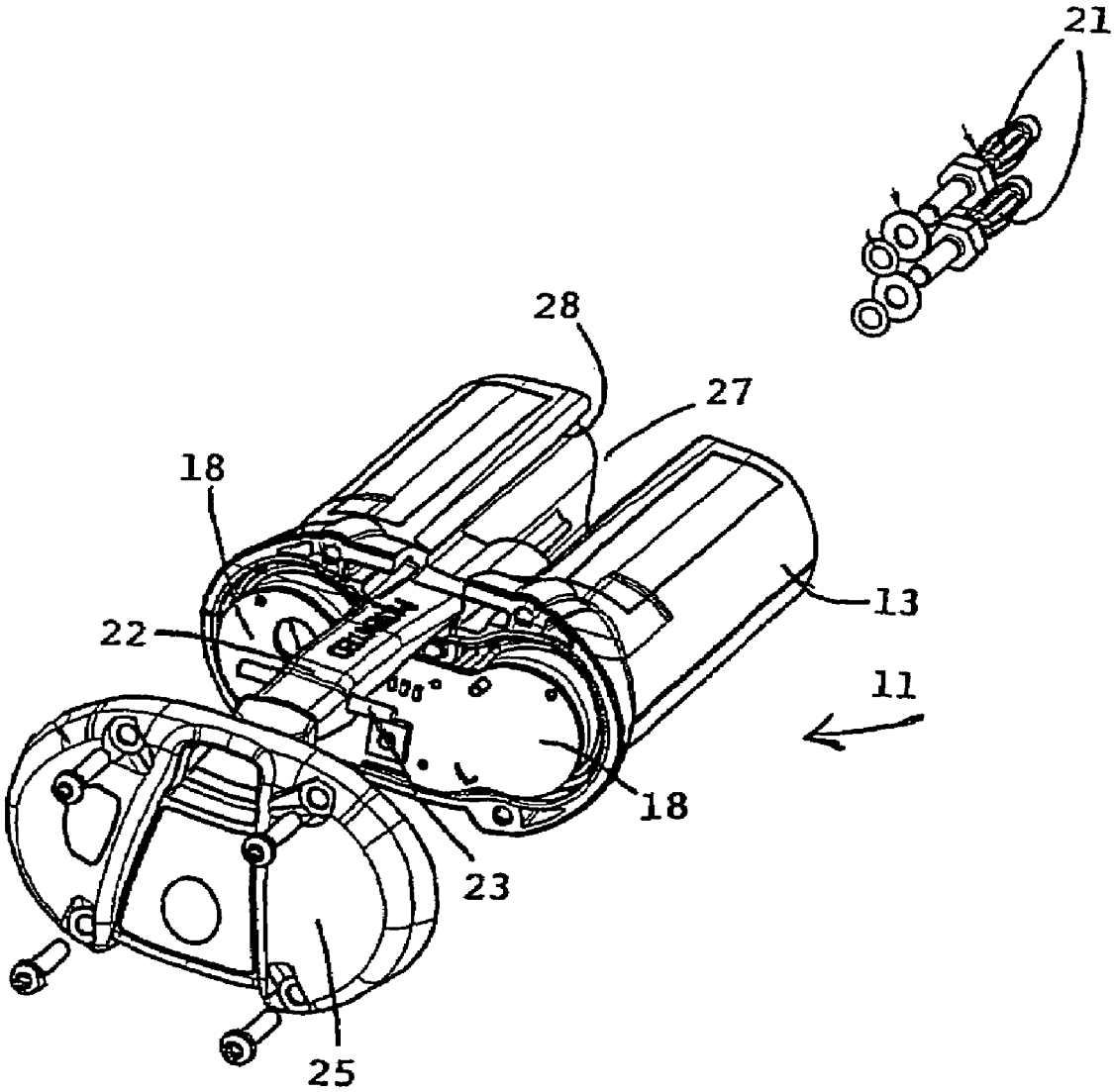

With reference to FIGS. 1 to 4, 6 and 8, a device for electric connection of a portable receiver is composed of an electric power supply connection 10 designed to be connected to a DC power source 11.

The portable receiver (not shown) is for example formed by an electric lamp with a bulb or light-emitting diodes, and electric connection 10 supplying this receiver comprises a sheath 12 housing two conducting wires insulated from one another. DC power source 11 comprises a case 13 separate from the receiver and housing disposable or rechargeable low-voltage batteries 18. Case 13 is sealed by a removable cover 25.

The end of electric connection 10 is equipped with a first connector 14 encapsulated in an enclosure 15 made from molded insulating material, in which enclosure a securing element 16 is fixed. First connector 14 comprises a pair of tubular female contacts 17 insulated from one another by the insulating material of enclosure 15. The side walls of enclosure 15 are provided with a pair of longitudinal grooves 19 (FIG. 4) to perform guiding of first connector 14 in translation during the connection phase with a second connector 20 associated to power source 11.

Second connector 20 is provided with a pair of male contacts 21 of banana plug type designed to engage in female contacts 17 of first connector 14. Latching means 22 are associated with second connector 20 by clipping into a notch 37 of securing element 16 of first connector 14 at the end of insertion travel. Latching means 22 are formed by a lever mounted swivelling around a pin 23 securedly attached to case 13, and comprising a clipping spigot 24 at the opposite end. A spring 26, which can for example be a torsion spring, is threaded onto pin 23 and biases the lever of latching means 22 to the securing position.

Housing 27 of case 13 is further equipped with means for guiding in translation to perform centring of male and female contacts 21, 17 in the plug-in direction of connectors 20, 14. The means for guiding comprise a slide 28 arranged at the level of latching means 22, and a pair of ribs 29 arranged in a horizontal plane between the two male contacts 21.

Figure 6:
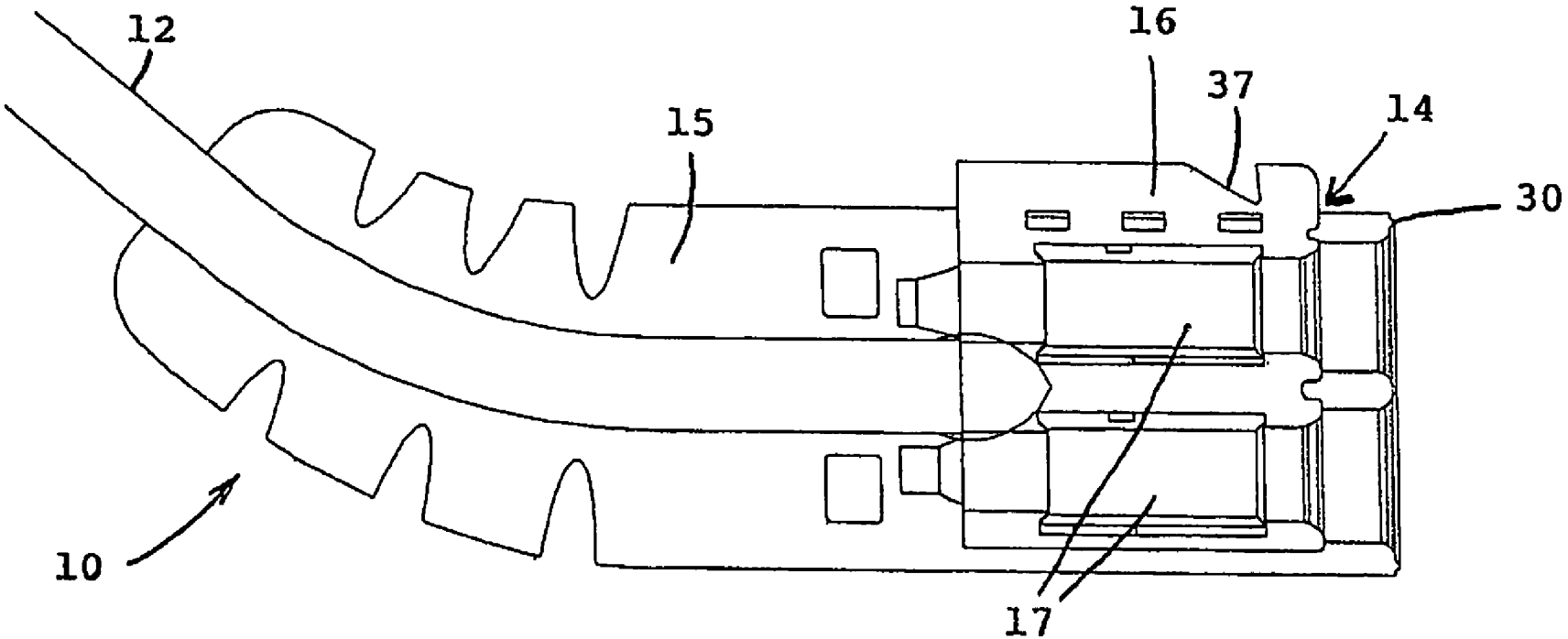
FIG. 6 shows a cross-sectional view of the first connector at the end of the electric connection to the receiver.

In FIG. 6, it can be observed that enclosure 15 of first connector 14 is salient with respect to the inputs of the female contacts 17, and is provided with a front sealing lip 30 that comes into engagement against a stop 31 of case 13 at the end of plug-in travel (FIG. 9) in second connector 20. Lip 30 is molded directly with enclosure 15 and ensures tightness to insulate the two polarities from one another, preventing any electrolysis effect between contacts 21.

Various connection modes are possible:

Direct Connection

In FIG. 6, first connector 14 of electric connection 10 is connected directly to second connector 20 of power source 11. First connector 14 simply has to be moved in the direction of arrow F1 to perform electric connection of male and female contacts 21, 17, and to achieve mechanical securing of latching means 22 on securing element 16 in a single movement. Centring of the female and male contacts of first and second connectors 14, 20 is achieved due to the longitudinal guiding of grooves 19 of enclosure 15 along ribs 29 of housing 27.

Disconnection of power source 11, for example to replace the disposable batteries or charge rechargeable batteries 18, is performed manually by first swivelling latching means 22 to an unlatched position in which spigot 24 is released from notch 37, followed by unplugging of contacts 21, 17.

Connection on a Support Plate

Figure 5:
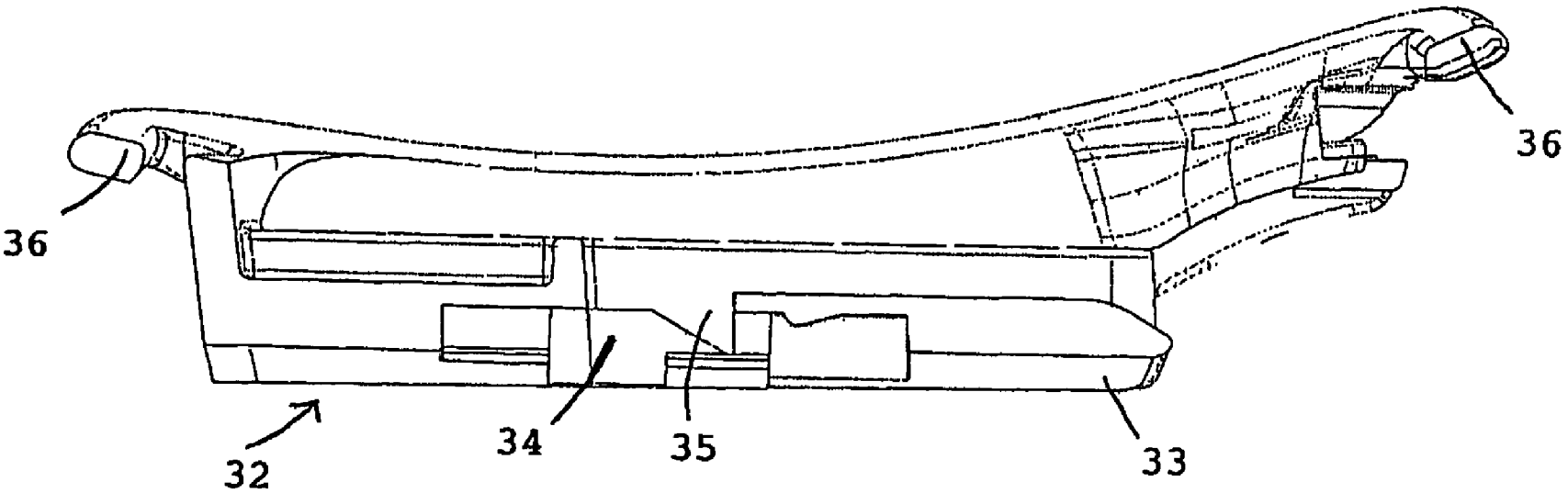
FIG. 5 represents a cross-sectional view of the support plate.
Figure 7:
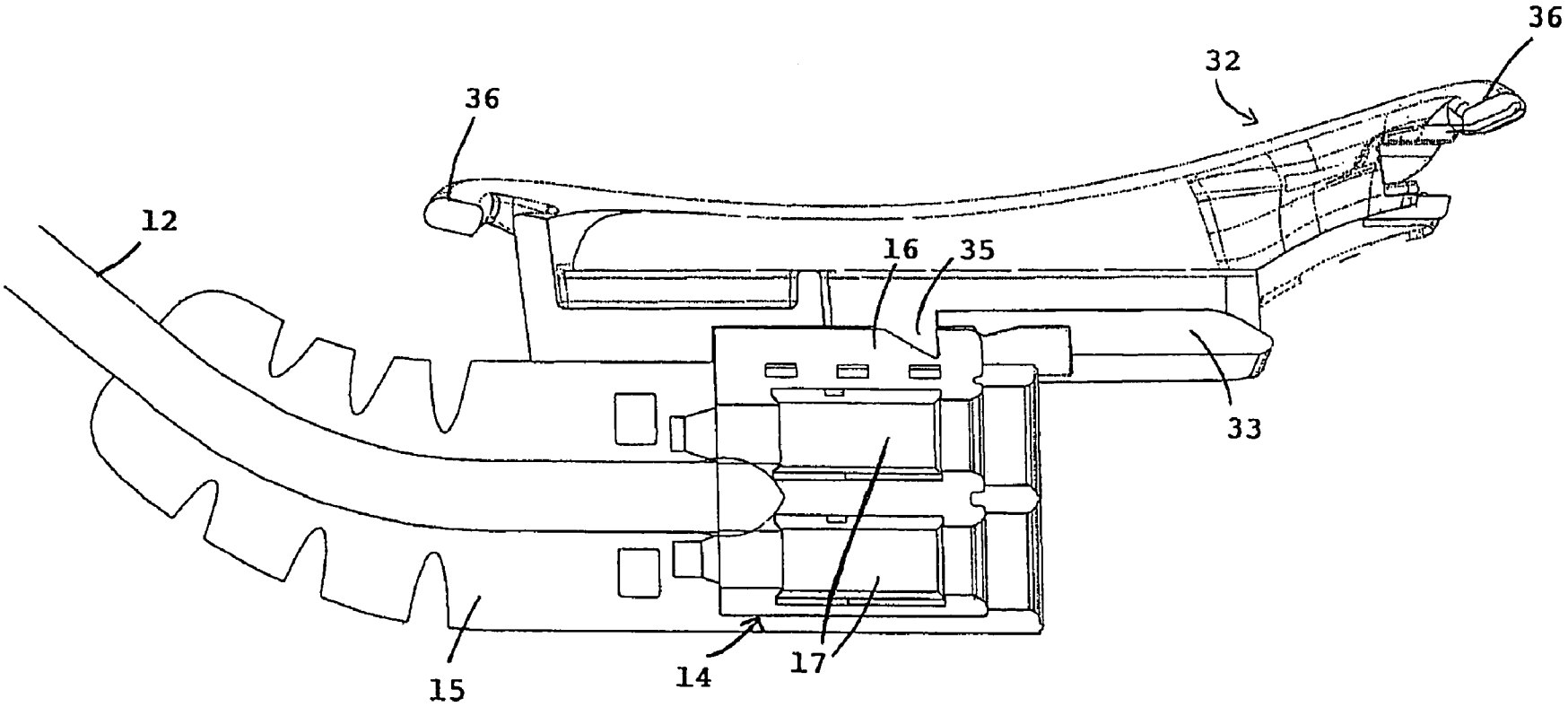
FIG. 7 illustrates fitting of the first connector of FIG. 6 on the support plate of FIG. 5.
Figure 8:
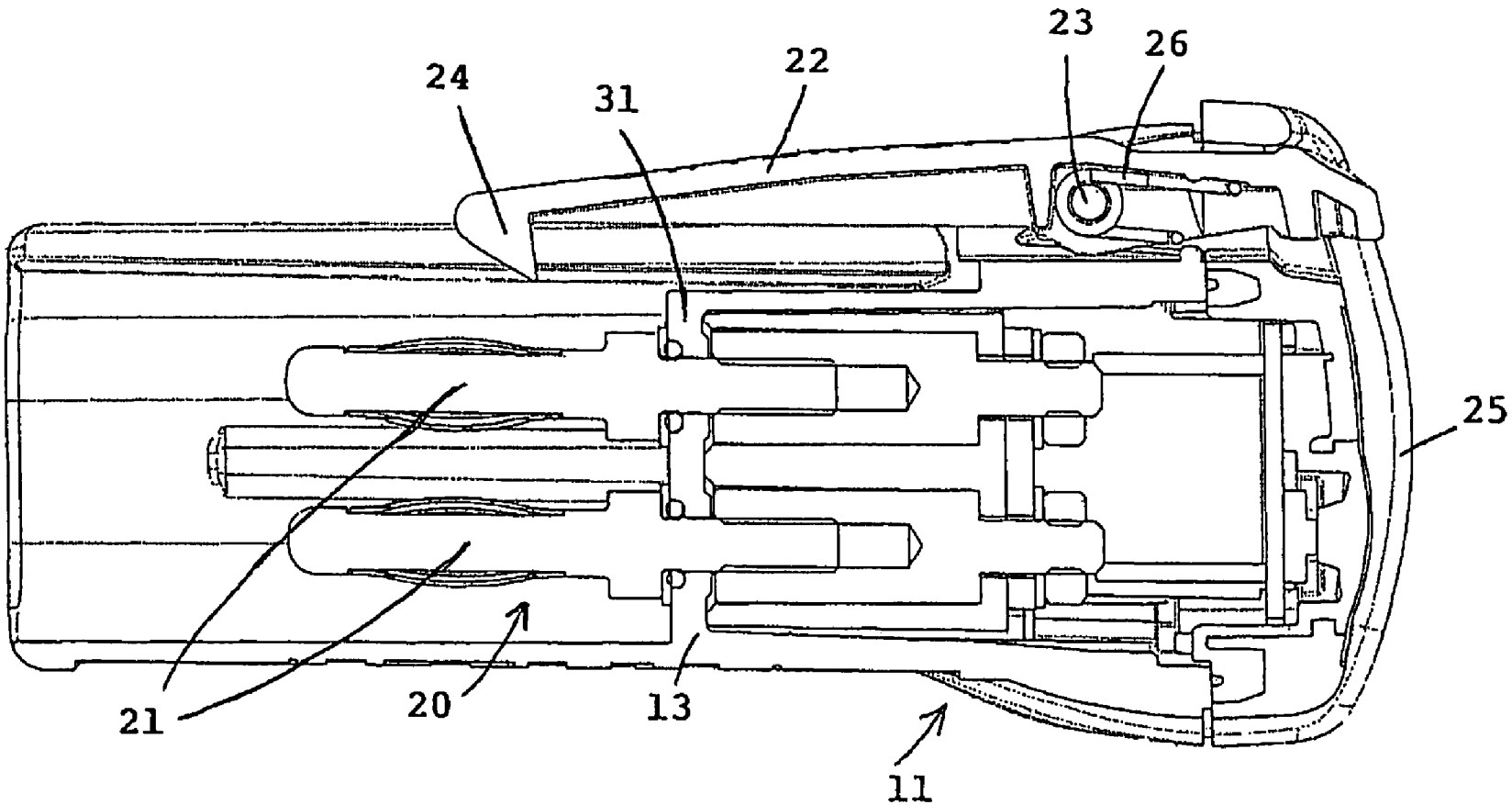
FIG. 8 is a cross-sectional view of the power source and of the second connector.
Figure 9:
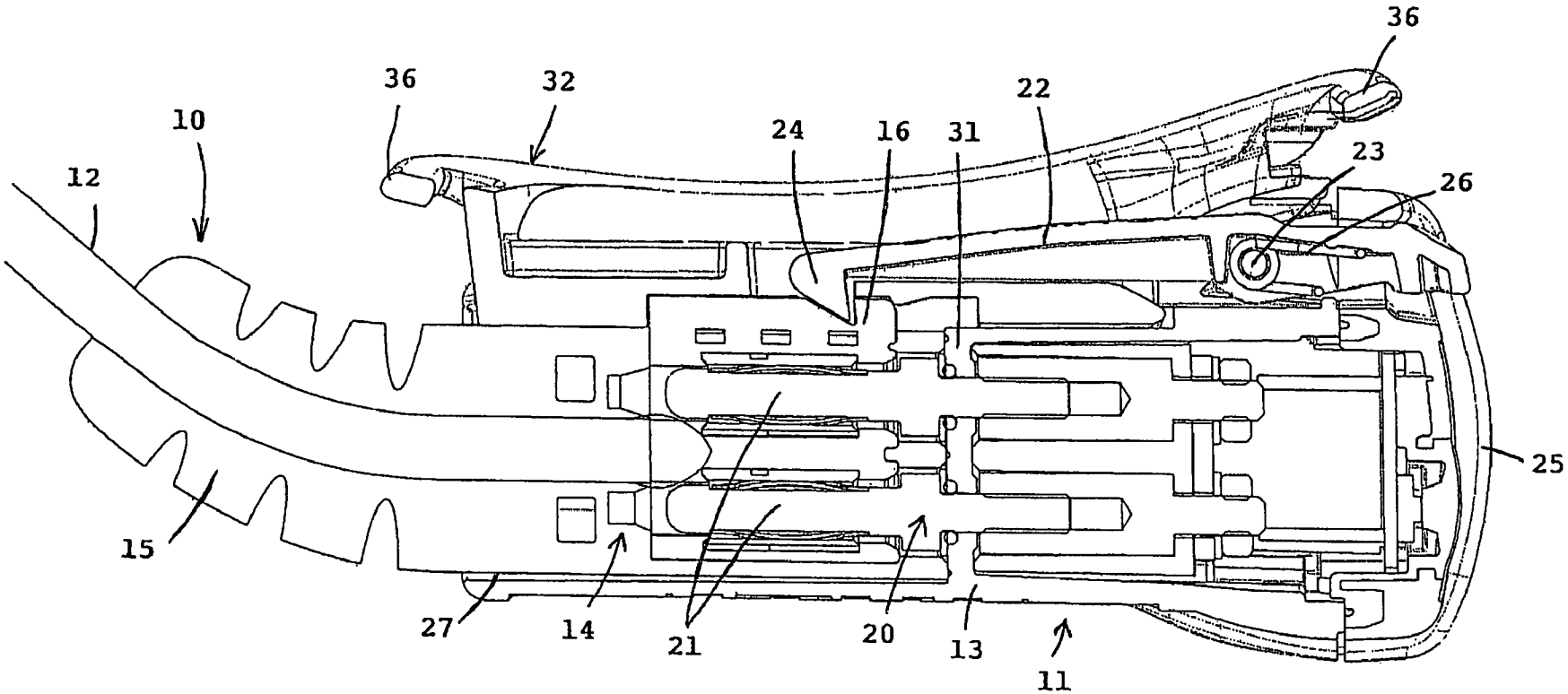
FIG. 9 is a cross-sectional view of the connectors in the position where the latter are plugged-in and latched on the plate with the power source.

In FIGS. 5, 7 and 9, connection of the two connectors 14, 20 is performed on a support plate 32 which comprises a fixing rail 33 in the form of a dovetail profile and a central opening 34 of conjugate shape to that of securing element 16. Plate 32 is manufactured by plastic molding and comprises a stop 35 inside opening 34. The ends of the body of plate 32 comprises loops 36 for elastic bands or straps attaching the receiver to pass through.

Connection is achieved by performing the following steps:

a first insertion movement of securing element 16 of first connector 14 in opening 34 of plate 32, followed by a second sliding movement to the rear until the latter comes into engagement against stop 35 which blocks first connector 14 in the functional position ready for connection of power source 11;

positioning of power source 11 facing first connector 14, followed by sliding of second connector 20 towards female contacts 17 of first connector 14, guiding in translation being performed by slide 28 of case 13 sliding along rail 33 of plate 32.

Such guiding ensures axial centring of male contacts 21 of second connector 20 on female contacts 17 of first connector 14 already fitted on plate 32. Electric connection of the receiver is then performed, and mechanical fixing of power source 11 on plate 32 is performed at the same time. Crushing of lip 30 at the end of plug-in travel guarantees tightness and insulation of the positive and negative poles of power source 11.

Disconnection is performed as in the previous case after latching means 22 have first been unlatched.

Male contacts 21 of second connector 20 and latching means 22 extend in parallel manner to the inside of a housing 27 of case 13 of power source 11, said housing being in the form of a longitudinal U-shaped notch, closed at one of the ends thereof and open at the opposite end to enable first connector 14 to be inserted.

The invention claimed is:

1. A device for electric connection between a power supply connector of a portable receiver and a DC power source housed in an insulating case, comprising:

a first connector arranged at an end of the power supply connector and designed to be electrically connected to a second connector securedly attached to the case of the power source, guiding means in translation for centring the connectors in a plug-in direction, wherein:

the first connector comprises a pair of female contacts overmolded by an insulating enclosure bearing a securing element operating by clipping in conjunction with a latching means associated with the second connector, which second connector is provided with a pair of male contacts arranged in a housing of the case of the power source, the latching means of the second connector are fixed onto the case above the housing, and the guiding means of the housing comprise a slide and a pair of ribs arranged in a horizontal plane between the two male contacts of the second connector.

2. The device according to claim 1, wherein the latching means are formed by a pivoting lever biased by a spring to a latching position.

3. The device according to claim 1, wherein the male contacts of the second connector and the latching means extend in parallel manner inside the housing of the case of the power source, the housing being in the form of a longitudinal U-shaped notch, closed at one end thereof and open at an opposite end to enable the first connector to be inserted.

4. The device according to claim 1, wherein the enclosure of the first connector is salient with respect to the inputs of the female contacts, and is provided with a front sealing lip that comes into engagement against a stop of the case at the end of plug-in travel in the second connector.

* * * * *